US005644938A

United States Patent [19]

Moeltner et al.

[11] Patent Number: 5,644,938

[45] Date of Patent: Jul. 8, 1997

[54] METHOD OF AND ROLL STAND FOR DIAGONAL ROLLING OF TUBES

[76] Inventors: Hermann Moeltner, St. Bernhard Strasse 41, 41516 Grevenbroich; Karlhans Staat, Wagnerstrasse 25, 40882 Ratingen, both of Germany

[21] Appl. No.: 514,700

[22] Filed: Aug. 11, 1995

[30] Foreign Application Priority Data

Aug. 12, 1994 [DE] Germany ..... 44 28 530.2

[51] Int. Cl.[6] ..... B21B 25/00

[52] U.S. Cl. ..... 72/96; 72/208

[58] Field of Search ..... 72/96, 208

[56] References Cited

FOREIGN PATENT DOCUMENTS

| | | | |
|---|---|---|---|
| 1527750 | 5/1970 | Germany . | |
| 3823135 | 4/1991 | Germany . | |
| 209414 | 11/1984 | Japan | 72/96 |
| 184790 | 7/1966 | U.S.S.R. | 72/96 |

*Primary Examiner*—Lowell A. Larson

*Attorney, Agent, or Firm*—Michael J. Striker

[57] ABSTRACT

In a method and a roll stand for diagonal rolling of medium or thin-walled tube ingots, an inner mandrel rod is held at an inlet side and controllably axially displaceably relative to rolls. In order to avoid a funnel-shaped expansion at the tube ingot end, the rolling product during rolling is rolled in a constriction of the mandrel rod and thereby obtains a thickened wall forming a support of the tube ingot wall against the expansion.

15 Claims, 4 Drawing Sheets

METHOD OF AND ROLL STAND FOR DIAGONAL ROLLING OF TUBES

BACKGROUND OF THE INVENTION

The present invention relates to a method of and a roll stand for diagonal rolling of tubes.

Various methods are known for diagonal rolling of tubes or tube ingots. Such diagonal rolling processes are performed for example on rolling devices identified as diagonal rolling mechanism, assel rolling mill, diescher rolling mill, planetary skew rolling mill, cone skew rolling mill, etc. When such devices are utilized for rolling medium or thin-walled rolling ingots, or in other words such which have a diameter/wall thickness ratio of approximately greater than 10:1, problems arise during rolling of the rear rolling ingot ends as considered in the rolling direction. During the rolling process they expand in a funnel-shaped manner in a radial direction, which leads to rolling errors and to jamming of the tube ingot ends in the caliber opening of the roll stand. The reason for this disadvantageous expansion is that during the progressing rolling process the support of the rolling ingot wall against the expansion due to the not yet rolled and therefore still thick-walled rear part of the rolling ingot progressively reduces and finally disappears.

For avoiding such an expansion of the tube ingot ends, it was proposed in the German patent document DE-PS 38 23 135 to reduce the outer diameter and/or the wall thickness of the tube ingot end before it is inserted in the caliber opening of the diagonal roll stand. In this known process an additional working step must be performed with respect to the rolling ingot ends and an additional device is needed which is suitable for reducing the tube ingot ends before the diagonal rolling itself.

Contrary to this, in accordance with the solution proposed in the German document DE-OS 15 27 750 the tube ingot ends are provided with a greater wall thickness. This is obtained in that during the diagonal rolling the rolls are displaced from one another in a radial direction when the tube ingot ends come into proximity to the rolls. The adjustment of the rolls required for this must be performed however precisely, which includes substantial difficulties and high expenses. This means that in addition to the rolls, also extensive bearing inserts and guiding elements or in other words many parts must be also adjusted synchronously and with a high accuracy to maintain the required roll tolerances. This involves further difficulties that the parts to be displaced have high weight and they are loaded during adjustment with great working forces. since the adjustment must be performed during the rolling. Moreover, it is necessary to perform the adjustment fast. so that the tube ingot ends with a thickened wall are maintained as brief as possible, which involves a substantial loss since later they are separated and must be scrubbed. Furthermore, the known processes cannot be utilized with planetary diagonal roll stands since there the rolls are supporting in a rotor which rotates with a high speed and therefore fast radial adjustment of the rolls during the rolling process is not possible.

SUMMARY OF THE INVENTION

Accordingly, it is an object of the present invention to provide a method and a roll stand for diagonal rolling of tubes, which avoids the disadvantages of the prior art.

The invention starts from a known method of diagonal rolling of medium and thin-walled tube ingots, in which a mandrel rod retained at the inlet side in an axially displaceable way is introduced into a tube ingot and subsequently both are introduced into a caliber opening formed by rolls and eventually guiding means, and during the rolling are displaced axially, wherein rearwardly as considered in a rolling direction a short tube ingot end is rolled with a thickened wall.

The objective of the invention is to provide a method and a diagonal roll stand in which the above disadvantages are eliminated and in which with low expenses rolling errors and operational disturbances are eliminated by reliably expanding tube ingot ends.

This objective is achieved in that the rolling product of the rear tube ingot end is rolled in a constriction of the controlled axially displacing mandrel rod and thereby is provided with a thickened wall.

The disadvantageous and undesired expansion of the rear tube ingot end is thereby avoided, in that the wall reduction at the tube ingot end is avoided and at the tube ingot end a thick-walled support is provided. In contrast to the known method, the wall thickening at the tube ingot end is produced not by providing a greater outer diameter, but instead by reducing the inner diameter of the tube ingot within a short end portion. No additional working step is required for this purpose and also no additional device, but instead a tube ingot end which has a thickened wall is provided during the diagonal rolling by tools of the diagonal roll stand which are involved in the rolling process anyway. This saves working time and additional investment cost. Moreover, in the inventive method it is not required to adjust the rolls, their extensive bearing inserts and eventually available guiding means in the radial direction when the tube ingot end runs into the caliber opening. The high multiple expenses for precise fast adjustment of the rolls and the guiding means can be thereby dispensed with. Only conventional adjusting devices are needed. Further, the inventive method can be used for all diagonal rolling processes, in which a mandrel rod is used as an inner tool. This is true also for the planetary diagonal rolling since in the inventive rolling method no radial adjustment of the rolls is needed.

With the controlled axial displacement of the mandrel rod during the rolling process, it is possible to position its constriction relative to the tube ingot end and to the rolls so that the tube ingot end with the supporting thickened wall is sufficiently long but remains as short as possible and thereby the material loss during separation of the tube ingot end with the thickened wall is retained low. The controlled axial displacement of the mandrel rod can be performed in the inventive method so that neither the movement direction, nor the movement speed of the mandrel rod is changed, which is advantageous for maintaining narrow tolerances of the wall thickness. Despite the fact that the speed and the movement direction remain as identical as possible, the mandrel rod is moved so that the tube ingot end together with the constriction of the mandrel rod run into the caliber opening and the tube ingot end is rolled in the region of the constriction of the mandrel rod.

In accordance with a further embodiment of the inventive method, the mandrel rod after the tube ingot end with the thickened wall passes the caliber opening, is pulled back to the inlet side and the tube ingot is stripped from the mandrel rod. The tube ingot during pulling back of the mandrel rod can be retained by a stripping element at the outlet side. This provision is recommended first of all for diagonal roll stands, such as for assel or diescher roll stands, in which the tube ingot is rotated during the rolling around its longitudinal axis. Contrary to this, it is also possible during pulling back of the mandrel rod to retain the rolling ingot by a subsequently arranged device for further machining of the tube ingot at the outlet side. This is recommended in particular for a planetary diagonal roll stand in which the rolling ingot during the rolling process is not rotated around its longitudinal axis and as a result their size or length reducing roll train can be arranged in a straight line and with a short distance directly after it so that it then engages the tube ingot and holds it back when the mandrel rod of the planetary diagonal roll stand is pulled back.

After finishing the diagonal rolling, the short tube ingot end with the thickened wall is no longer needed as a support and means against the undesired expansion of the tube ingot end. There is then the possibility to separate the tube ingot end with the thickened wall after passing the caliber opening from the tube ingot and later remove the remaining tube ingot from mandrel rod. Another possibility resides in that the tube ingot end with the thickened wall after stripping of the tube ingot from the mandrel rod can be expanded by a conical longitudinal portion of the mandrel rod and stripped from the remaining tube ingot from the mandrel rod. The further possibility is however especially advantageous, in accordance with which the tube ingot end with the thickened wall is expanded both by a conical longitudinal portion of the mandrel rod as well as by round zones of the rolls to a greater inner diameter than the outer diameter of the mandrel rod and rolls from the constriction of the mandrel rod. The latter mentioned possibility is therefore especially advantageous since first the tube ingot end with the thickened wall which serves as a support is rolled by the mandrel rod and the end of the rolling process, and thereby a separation of the tube ingot end in the region of the diagonal roll stand is avoided.

Furthermore, it is advantageous when the rear tube ingot end is prevented by a shoulder-like projection from a further displacement on the mandrel rod against the roll direction over the rear end of the constriction. This ensures a reliable feed of the rolling product at the beginning of the rolling process and prevents an excessive displacement of the rolling product on the mandrel rod against the rolling direction.

It is also an object of the present invention to provide a diagonal roll stand for performing the inventive method, with a mandrel rod which is held at an inlet side and is controllably axially displaceable during the rolling. Moreover, it is immaterial what is the design of the diagonal rolling stand. In accordance with the present invention, the mandrel rod of the diagonal roll stand is provided in the region of its rear longitudinal portion as considered in the rolling direction, with a constriction for receiving the rolling product and therefore for rolling a tube ingot end with a thickened wall. It is recommended to select the diameter of the constriction so that with the same position of the rolls and in some cases of the guiding means, the roll ingot end obtains such a thickened wall and thereby such a sufficient support that no disadvantageous funnel-shaped expansion of the tube ingot end occurs. The thicker the wall of the tube ingot end, the lower is the tendency for expansion. On the other hand, for the reasons of efficiency the low thickening of the tube ingot end must be selected as small as possible and the diameter of the constriction must be selected as great as possible, so that the wall thickness is sufficient for preventing a significant expansion.

The mandrel rod in accordance with the present invention can be provided with a conical longitudinal portion in the region of each front transition, as considered in the rolling direction, between the constriction and the main parts of the mandrel rod. Such a conical longitudinal portion of the mandrel rod at this location can be used for expanding the tube ingot end with its inwardly directed wall thickening so that it can be easily stripped over the main part of the mandrel rod. For expansion, in many cases it is sufficient to use the pulling back force of the mandrel rod relative to the tube ingot which is retained always with corresponding means. A ring-shaped bead with a substantially greater outer diameter of the conically shaped front transition to the main part of the mandrel rod provides for somewhat greater expansion so that a stretching of the mandrel rod during the pulling back and stripping of the tube ingot can be avoided.

In accordance with a further feature of the present invention, the mandrel rod in the region of its front transition between the constriction and the main part of the mandrel rod, is provided with a small, preferably partition-like rim of a greater diameter than the main part of the mandrel rod. With such a partition-like rim, it is possible to provide during rolling of the wall of the tube ingot a notch at a location shortly before the tube ingot end with the thickened wall in a peripheral direction, so that this notch leads to breaking of the tube ingot end with the thickened wall from the main part of the tube ingot when the mandrel rod is pulled back against the holding force of a subsequent device acting on the tube ingot, for example a subsequently arranged length reducing roll train. The short tube ingot end which remains on the mandrel rod can be removed by a stripper or in another manner from the mandrel rod before it is inserted into the next tube ingot.

It is advantageous when a retractable and expansible stripping element is provided at the outlet end behind the rolls in the roll line. This however can be dispensed with when a conical longitudinal portion between the constriction and the main part of the mandrel rod can cooperate by a longitudinal displacement of the mandrel rod with the rolls in particular the round zones of the rolls, and in this way the tube ingot end with the thickened wall can be rolled at the end of the rolling process and the forwardly moving tube ingot longitudinal portion is engaged by a subsequently arranged device.

Then the mandrel rod at the rear end of the constriction as considered in the rolling direction is provided with a shoulder-like projection, it is recommended to select its outer diameter greater than the inner diameter of the tube ingot. In accordance with a further embodiment of the invention, the outer diameter of the shoulder-like projection can be greater than the inscribed circle of the caliber opening. The latter is possible since the mandrel rod is not guided with its rear end and the shoulder-like projection provided on it through the caliber opening. At the beginning of the rolling process, the shoulder-like projection ensures that the tube ingot is reliably moved into the caliber opening by the receiving table when the inner diameter of the inserted tube ingot before the rolling is substantially greater than the outer diameter of the mandrel rod. The tube ingot can be always moved only to the shoulder shaped projection on the mandrel rod, and then the tube ingot is positively guided by the axially driven mandrel rod into the caliber opening.

When during insertion of the tube ingot into the caliber opening, the tube ingot end abuts against the shoulder shaped projection of the mandrel rod, the mandrel rod during the rolling process passes through the caliber opening with acceleration because of the feeding action of the rolls which acts through the rolling product also on the mandrel rod in the region of the caliber opening in the rolling direction. This accelerated passage ends when the tube ingot end abuts against the shoulder shaped projection of the mandrel rod.

The rolls try to displace the mandrel rod in the rolling direction through the rolling product relative to the tube ingot end, which however can no longer be performed since the mandrel rod is supported through its shoulder shaped projection at the tube ingot end which is located before the caliber opening. Only together with the advancement of the tube ingot end, the mandrel rod can move then and so further in the rolling direction before a predetermined fixed end position shortly before the rolls, without contacting the shoulder shaped projection of the rolls. In this position of the mandrel rod which is fixedly held in the axial direction, the rear tube ingot end which is rolled in the constriction and therefore wall-thickened can be rolled out of the constriction through the conical longitudinal portion at the front transition between the constriction and the main part of the mandrel rod, and in particular by cooperation of the round zones of the rolls, with the conical longitudinal portion of the mandrel rod. The roll tube end is released from the shoulder shaped projection and rolled through as the front longitudinal portion of the tube ingot through the caliber opening.

When the tube ingot is engaged at the outlet end for example by a subsequent device for further machining, the mandrel rod can be pulled back to the inlet side and is available for insertion into the next tube ingot or into the next hollow block, and in some cases after a cooling and lubricating step at the inlet side.

The above described operation allows a fast and continuous rolling product sequence and thereby a high productivity, and also a direct arrangement of the devices for further machining of the tube ingot at a short distance after the diagonal roll stand, which is not space consuming but instead saves an intermediate warming thereby investment and operational costs required for it. This is true first of all for the combination of a planetary diagonal roll stand and a length reducing roll train or a size roll train.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
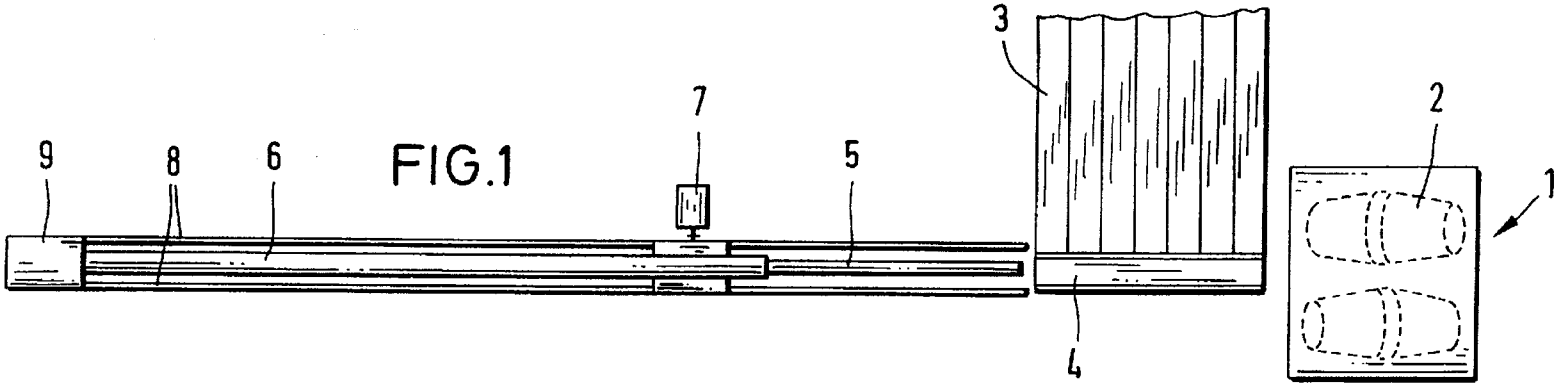
FIGS. 1 and 2 are plan views of a diagonal roll stand before and during rolling.

FIG. 1 shows schematically a diagonal roll stand 1 with two rolls, in which of course, another number and type of rolls can be utilized as well. Moreover, guiding elements such as guiding shoes, guiding discs and similar elements can be provided as well known in diagonal roll stands. The diagonal roll stand 1 can also be formed as a planetary diagonal roll stand. The drive of the roll stand is not shown since it can be of any type. A hollow block or a tube ingot 4 is supplied by a transverse transporting means 3 into the roll line and in particular at an inlet side between the diagonal roll stand 1 and the mandrel rod 5 which is pulled back from the diagonal roll stand 1. The mandrel rod 5 and a coupled shaft rod 6 which extends it can be controllably displaced in an axial direction by means of a motor 7 inside a guide 8 by a mandrel rod abutment 9.

Figure 2:
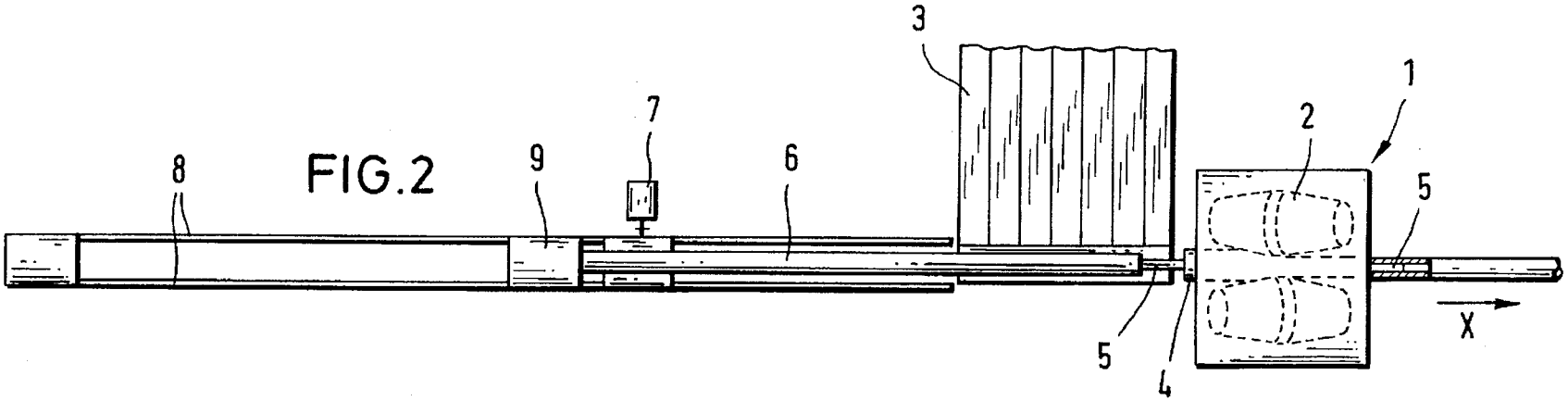

FIG. 2 shows the diagonal roll stand 1 of FIG. 1 but with the forwardly displaced mandrel rod 5, the shaft rod 6 and the mandrel rod abutment 9. The tube ingot 4 is already rolled and extends at the outlet side from the diagonal roll stand 1. The mandrel rod 5 in a further course of the rolling process is moved substantially in the rolling direction X and then after ending of the rolling process is pulled back to the inlet side to the position shown in FIG. 1.

Figure 3:
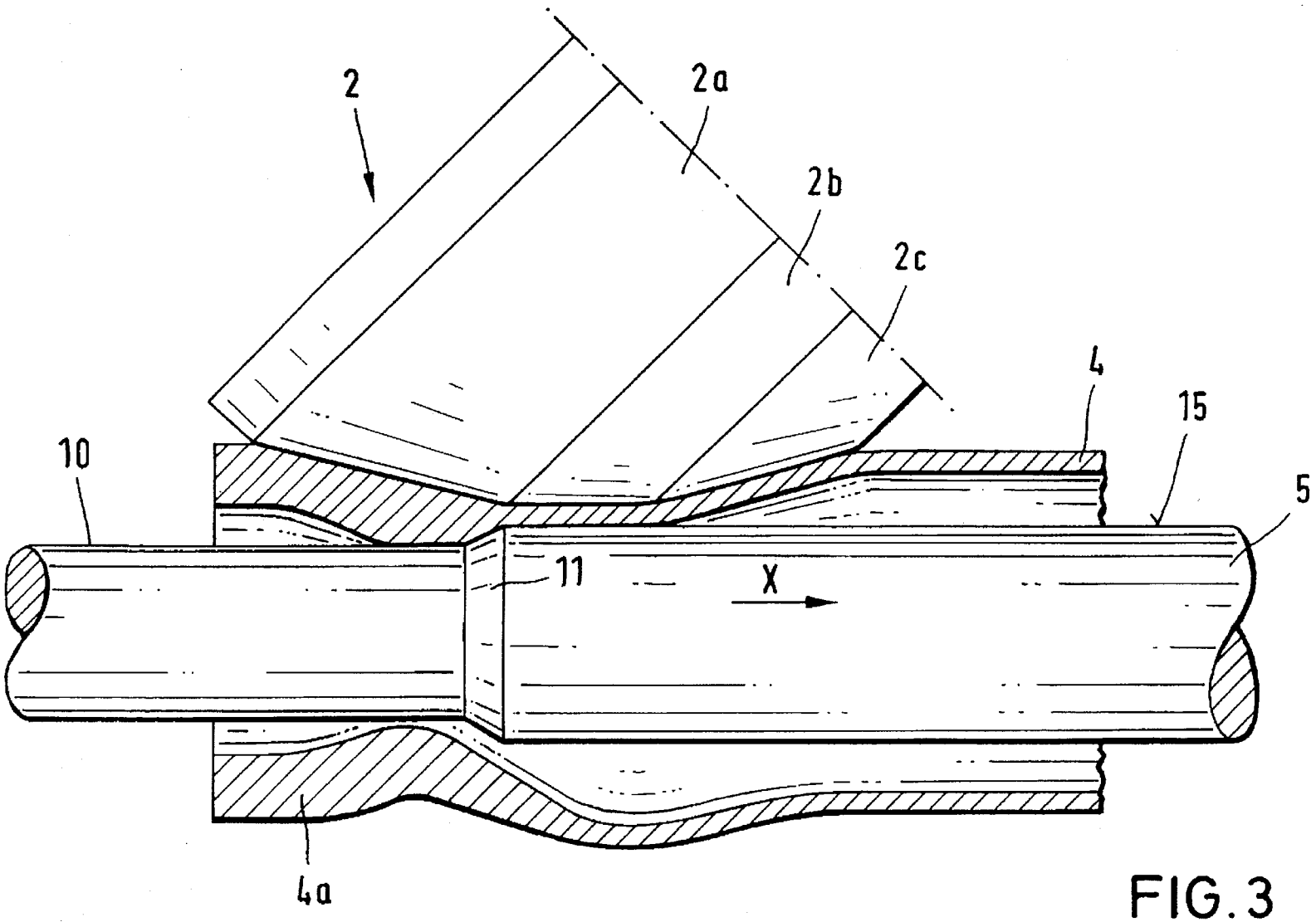
FIG. 3 is a view showing a rolling of a tube ingot end into a constriction in accordance with the present invention.

FIG. 3 shows the mandrel rod 3 on an enlarged scale and in particular its rear longitudinal portion as considered in the rolling direction X, shortly before the not shown shaft rod 5. The mandrel rod 5 has in this region a constriction 10. In order to show that other types of diagonal roll stands 1 can be utilized, FIG. 3 shows in contrast to FIGS. 1 and 2 a roll 2 which is substantially frustoconical. Since two or more rolls 2 distributed over the periphery of the tube ingot 4 can be provided, and the other rolls 2 are located not in the shown section plane, the other rolls 2 are not shown in FIG. 3. A reduction zone **2*a* of the roll 2 reduces the outer diameter of the tube ingot 4 and a smoothing zone 2*b* determines together with the outer surface 15 of the mandrel rod 5 the new wall thickness of the tube ingot 4. The inner and outer surfaces of the tube ingot 4 are therefore smoothened. A round zone 2*c* imparts to the tube ingot 4 a shape which is circular in the cross-section. In FIG. 2 the rear tube ingot end 4*a* is rolled and the rolling product at this location is rolled in the constriction 10 of the mandrel rod 5 when with the same roll position it obtains a substantially thicker wall than the preceding longitudinal portion of the tube ingot 4. Since the mandrel rod 5 in a further course of the rolling process is moved only a piece in the rolling direction X through the caliber opening formed by the rolls 2, a constriction 10 with the rear tube ingot end 4*a*' and its thickened wall moves to the outer side of the diagonal roll stand 1 and therefore during the whole rolling process can support the forwardly arranged longitudinal portion of the tube ingot 4** with a thinner wall, which prevents a funnel-shaped radial expansion.

Figure 4:
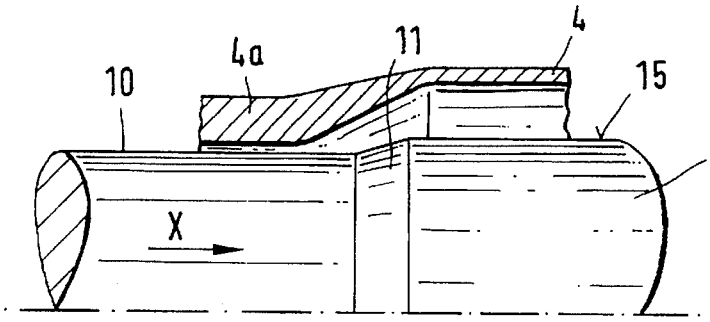
FIG. 4 is a view showing a finally rolled tube ingot end before stripping.
Figure 5:
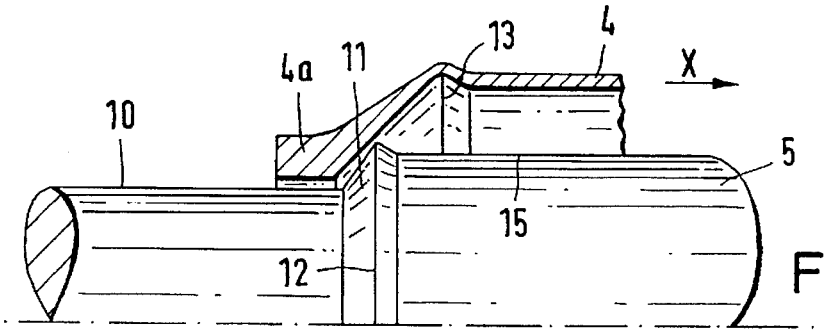
FIGS. 5–8 are views showing tube ingot ends with rolled notches in accordance with the present invention.

FIG. 4 shows how the rear tube ingot end **4*a* looks after ending of the rolling process. It is located at the outlet side of the diagonal roll stand 1 behind the rolls 2. A longitudinal portion 11 is located between the constriction 10 and the main part of the mandrel rod 5 and is formed conically. When the mandrel rod 5 driven by the motor 7 in FIG. 1 is pulled back and therefore the tube ingot 4 is fixedly held at the outlet side, the conical longitudinal portion 11 expands the rear tube ingot end 4*a* so that the tube ingot 4 can be stripped from the mandrel rod 5**.

Figure 6:
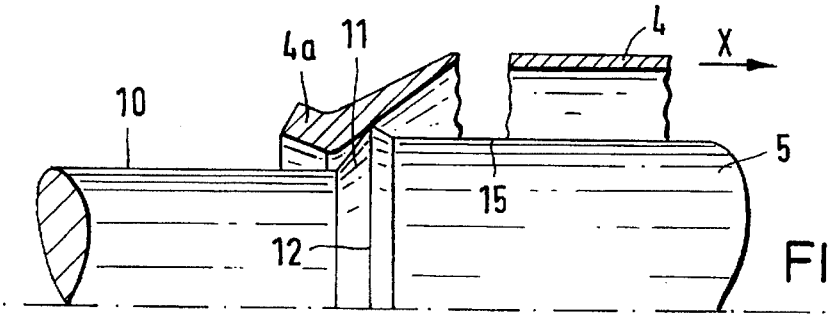

FIGS. 5–8 show possibilities through wear of the outer surface 15 of the mandrel rod 5 by the rear tube ingot end **4*a* can be avoided. As can be seen from FIG. 4, in this embodiment example a conical longitudinal portion 11 is provided in the region of the front transition as considered in the rolling direction, between the constriction and the main part of the mandrel rod 5. A cutter-like rim 12 is located in the region of this longitudinal portion 11 and has a greater diameter than the main part of the mandrel rod 5. During pressing of the cutter-like rim 12 through the caliber opening a notch is rolled in the tube ingot 4 shortly before the rear tube ingot end 4***a*, so that the wall thickness at this location of the tube ingot 4 is very thin. With corresponding dimensioning of the cutter-like rim 12 relative to the caliber opening formed by the rolls 2, the notch 13 can be so deep that when a sufficient pulling load occurs in this region for example due to fixing or further movement of the tube ingot 4 and pulling back of the mandrel rod 5, the rear tube ingot end 4*a* is torn off as shown in FIG. 6. The tube ingot 4 can be then easily separated from the mandrel rod 5, while the rear tube ingot end 4*a* is first retained on the mandrel rod 5 and at a later time is separated from it. This can be performed by suitable and known means, such as for example a stripping element either at the inlet side or at the outlet side of the diagonal roll stand 1.

Figure 7:
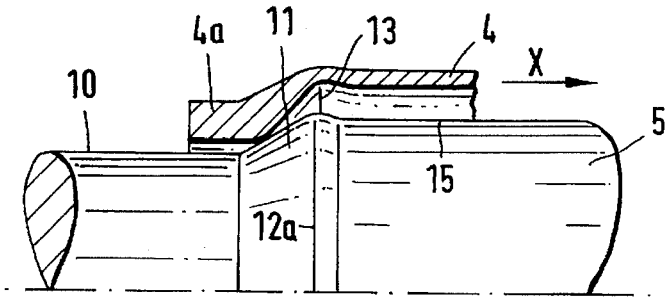
Figure 8:
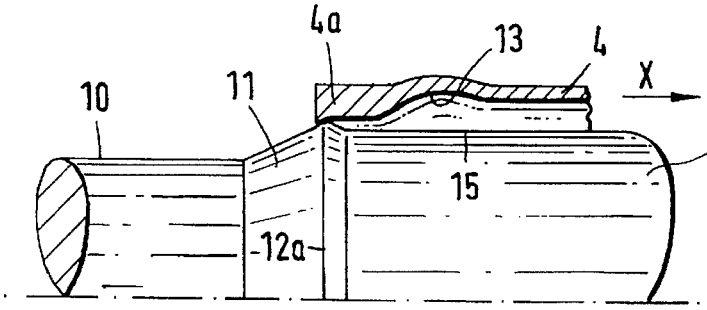

In contrast to FIG. 6, the notch 13 in FIG. 7 is less deep so that the rear tube ingot end 4*a* is not torn off when the tube ingot 4 is pulled from the mandrel rod 5 for example by a subsequently arranged device for further machining as considered in the rolling direction X. The inner tube ingot end 4*a* is however expanded by the conical longitudinal portion 11, obtaining by the rounded rim 12*a* a greater inner diameter than the outer diameter of the main part of the mandrel rod 5 (FIG. 8), so that its outer surface 15 during stripping of the tube ingot 4 is fined.

Figure 9:
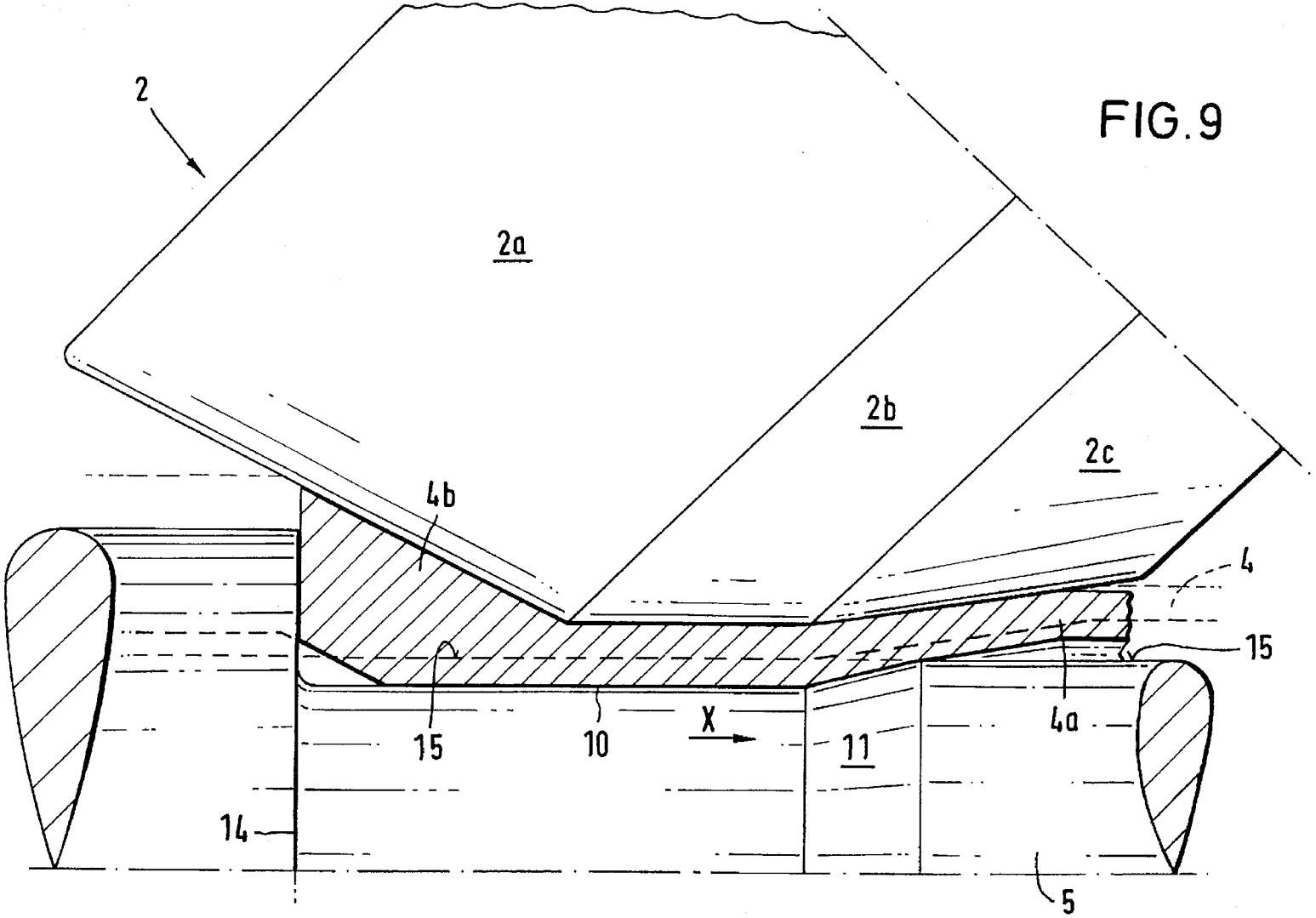
FIG. 9 is a view showing a tube ingot end during rolling out from the constriction.

While FIG. 3 shows rolling of the rolling product in the constriction 10 of the mandrel rod 5 and thereby the formation of the thickened rear tube ingot end 4*a*, FIG. 9 shows the increase of the inner diameter of the rear tube ingot end 4*a* at the end of the rolling process, so as to facilitate stripping of the tube ingot 4 from the mandrel rod 5 and to avoid damaging of the outer surface 15 of the mandrel rod. The mandrel rod 5 which in its position in which it is displaced the farthest and is firmly held at the inlet side via the mandrel rod 5 and the mandrel rod abutment 9 with the stopped motor 7. This can be recognized from the shoulder-like projection 14, which the mandrel rod 5 has at its rear end of the constriction 10 as considered in the rolling direction X- The outer diameter of the shoulder shaped projection 14 is substantially greater than the inner diameter of the hollow block or the tube ingot 4, so that its rear end can be displaced at any time points farther on the mandrel rod 5.

Due to the greater outer diameter of the shoulder shaped projection 14, the mandrel rod 5 must be held in the shown position so that the shoulder shaped projection 14 does not contact the rolls 2 as shown in FIG. 9. It can be clearly recognized from the drawing that the rear tube ingot end 4*a* with its connecting piece 4*b* obtains due to the unchanged position of the rolls 2, in particular their reduction and smoothing zones 2*a* and 2*b*, substantially the same outer diameter as the front longitudinal portion of the tube ingot 4. The thicker wall on the connecting piece 4*b* of the rear tube ingot end 4*a* is thinner and the inner surface of the tube ingot 4 is released from the mandrel rod 5. The situation during rolling of the rear tube ingot end 4*a* is shown with thick solid lines, and the constriction 10 of the mandrel rod 5 is located completely in the region of the roll 2. The produced substantially thickened rear tube ingot end 4*a* is released from the outer surface 15 of the mandrel rod 5, since the round zone 2*c* of the rolls 2 together with the conical longitudinal portion 11 of the mandrel rod 5 provide an expansion.

Broken lines identify in FIG. 9 such situation which is produced during rolling of the greater part of the tube ingot 4. The constriction 10, the conical longitudinal portion 11, and the shoulder-like projection 14 are located not in the region of rolls 2, but instead at portion of the main part of the mandrel rod 5 and its outer surface 15. Since the outer diameter of the outer surface 15 is greater than that of the constriction 10, a substantially smaller wall thickness of the tube ingot 4 is produced with unchanged position of the roll 2, whose inner surface is released in the front region from the outer surface 15 of the mandrel rod 5. This can also lead to a substantially greater outer diameter of the tube ingot 4 relative to its wall-thickened rear tube ingot end 4*a*.

The tube ingot can be held at an outlet side during pulling back of the mandrel rod, by a subsequently arranged device for a further machining of the tube ingot at the outlet side. The tube ingot end with the thickened wall is separated from the tube ingot after passing the caliber opening, and later the separated tube ingot end and the remaining tube ingot portion are removed from the mandrel rod. An expandable and retractable stripping member can be provided in a roll line behind the rolls at an outlet side.

It will be understood that each of the elements described above, or two or more together, may also find a useful application in other types of methods and constructions differing from the types described above.

While the invention has been illustrated and described as embodied in a method of and roll stand for diagonal rolling of tubes, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of diagonal rolling of medium and thin-walled tube ingot, comprising the steps of introducing into a tube ingot a mandrel rod; then introducing both the mandrel rod and the tube ingot into a caliber opening formed by rollers and axially displacing the mandrel rod and the tube ingot during rolling; rolling a rear end of the tube ingot as considered in a rolling direction in a rear constriction of the controllably axially displaceable mandrel rod so as to produce a thickened wall over a short length, retaining mandrel end always at an inlet side of said rollers; and pulling back the mandrel rod to the inlet side after the tube ingot end with the thickened wall passes through the caliber opening so as to thereby strip the tube ingot from the mandrel rod at an outlet side.

2. A method as defined in claim 1; and further comprising the step of holding the tube ingot at an outlet side by a stripping member during pulling back of the mandrel drill.

3. A method as defined in claim 1; and further comprising the step of holding the tube ingot at an outlet side during pulling back of the mandrel rod, by a subsequently arranged device for a further machining of the tube ingot at an outlet side.

4. A method as defined in claim 1; and further comprising the steps of separating the tube ingot end with the thickened wall from the tube ingot after passing through the caliber opening; and later removing the separated tube ingot end and a remaining tube ingot portion from the mandrel rod.

5. A method as defined in claim 1; and further comprising the steps of expanding the tube ingot end with the thickened wall by a conical portion of the mandrel rod during the stripping of the tube ingot from the mandrel rod; and stripping the tube ingot end together with a remaining tube ingot from the mandrel rod.

6. A method as defined in claim 1; and further comprising the steps of expanding the tube ingot end with the thickened wall to a greater inner diameter than an outer diameter of the mandrel rod, both by a conical longitudinal portion of the mandrel rod as well as by round zones of the rolls so as to roll the tube ingot end from the constriction of the mandrel rod.

7. A method as defined in claim 1; and further comprising the step of preventing the tube ingot end from a further displacement on the mandrel rod over a rear end of the constriction, by a shoulder-shaped projection.

8. A roll stand for diagonal rolling of tubes, comprising a plurality of rolls forming a caliber opening; a mandrel rod which is controllably axially displaceable relative to said rolls, said mandrel rod having a rear longitudinal portion as considered in a rolling direction and being provided in the region of said rear longitudinal portion with a constriction for receiving a rolling product and thereby for rolling a tube ingot end with a thickened wall, said mandrel rod having a rear end always located at an inlet side of said rollers, said mandrel rod being pullable back to the inlet side of said rollers after the tube ingot end with the thickened wall passes through the caliber opening so as to thereby strip the tube ingot from the mandrel rod at an outlet side.

9. A roll stand as defined in claim 8; and further comprising an expandable and retractable stripping member provided in a roll line behind said rolls at an outlet side.

10. A roll stand as defined in claim 8, wherein said constriction of said mandrel rod has a rear end as considered in the rolling direction and is provided at said rear end with a shoulder shaped projection having an outer diameter which is greater than an inner diameter of the tube ingot.

11. A roll stand as defined in claim 10, wherein said outer diameter of said shoulder shaped projection is greater than an inscribed circle of said caliber opening.

12. A roll stand as defined in claim 8, wherein said mandrel rod is axially displaceable during rolling.

13. A roll stand for diagonal rolling of tubes, comprising a plurality of rolls forming a caliber opening; a mandrel rod which is controllably axially displaceable relative to said rolls, said mandrel rod having a rear longitudinal portion as considered in a rolling direction and being provided in the region of said rear longitudinal portion with a constriction for receiving a rolling product and thereby for rolling a tube ingot end with a thickened wall, said mandrel rod having a rear end always located at an inlet side of said rollers, said mandrel rod having a front transition between said constriction and a main part of said mandrel rod and being provided in a region of said front transition with a conical longitudinal portion, said mandrel rod having a front transition between said constriction and a main part of said mandrel rod and is provided in the region of said transition with a rim which has a greater diameter than a diameter of said main part of said mandrel rod.

14. A roll stand as defined in claim 13, wherein said rim is a cutter-shaped rim.

15. A roll stand for diagonal rolling of tubes, comprising a plurality of rolls forming a caliber opening; a mandrel rod which is controllably axially displaceable relative to said rolls, said mandrel rod having a rear longitudinal portion as considered in a rolling direction and being provided in the region of said rear longitudinal portion with a constriction for receiving a rolling product and thereby for rolling a tube ingot end with a thickened wall, said mandrel rod having a rear end always located at an inlet side of said rollers, said mandrel rod having a front transition between said constriction and a main part of said mandrel rod and being provided in a region of said front transition with a conical longitudinal portion.

* * * * *